US007731631B2

(12) United States Patent
Collias

(10) Patent No.: US 7,731,631 B2
(45) Date of Patent: Jun. 8, 2010

(54) WEIGHTLIFTING APPARATUS

(76) Inventor: Constantine Dean Paul Collias, 315 Garrison Dr., Kings Mountain, NC (US) 28086

( * ) Notice: Subject to any disclaimer, the term of this patent is extended or adjusted under 35 U.S.C. 154(b) by 1352 days.

(21) Appl. No.: 11/058,143

(22) Filed: Feb. 15, 2005

(65) Prior Publication Data

US 2006/0183607 A1 Aug. 17, 2006

(51) Int. Cl.
*A63B 9/00* (2006.01)

(52) U.S. Cl. ..... 482/35; 482/23; 482/38

(58) Field of Classification Search ..... 482/23–30, 482/908, 35, 36, 37, 38, 41–43, 148, 130, 482/142

See application file for complete search history.

(56) References Cited

U.S. PATENT DOCUMENTS

| | | | | |
|---|---|---|---|---|
| 1,104,505 | A * | 7/1914 | Holworthy | 482/24 |
| 3,207,511 | A * | 9/1965 | Hoffman | 482/42 |
| 3,268,224 | A * | 8/1966 | Freshour | 482/104 |
| 4,231,570 | A * | 11/1980 | Reis | 482/104 |
| 4,252,314 | A * | 2/1981 | Ceppo | 482/104 |
| 4,382,596 | A | 5/1983 | Silberman | |
| 4,635,930 | A * | 1/1987 | Cormier | 482/104 |
| 4,757,998 | A | 7/1988 | Landin | |
| 4,828,252 | A * | 5/1989 | Bowen et al. | 482/98 |
| 4,919,419 | A | 4/1990 | Houston | |
| 4,928,961 | A | 5/1990 | Madden | |
| 5,082,260 | A | 1/1992 | Dinelli | |
| 5,151,072 | A | 9/1992 | Cone et al. | |
| 5,250,013 | A * | 10/1993 | Brangi | 482/98 |
| 5,306,220 | A | 4/1994 | Kearney | |
| 5,433,686 | A | 7/1995 | Marsh | |
| 6,168,548 | B1 * | 1/2001 | Fleming | 482/23 |
| 6,565,495 | B2 * | 5/2003 | Slattery | 482/142 |
| 2001/0034289 | A1 * | 10/2001 | Parrillo | 482/94 |
| 2007/0203002 | A1 * | 8/2007 | Webber | 482/104 |

* cited by examiner

*Primary Examiner*—Jerome W. Donnelly
(74) *Attorney, Agent, or Firm*—Adams Intellectual Property Law

(57) ABSTRACT

A weightlifting apparatus includes a pair of spaced-apart support columns which carry a pair of spaced-apart self-spotter bars. The self-spotter bars extend from the columns such that the height and optionally the angle can be adjusted. The self-spotter bars are positioned to hold a weight bar at a safe height should the user drop the weight during an exercise.

18 Claims, 8 Drawing Sheets

WEIGHTLIFTING APPARATUS

TECHNICAL FIELD AND BACKGROUND OF THE INVENTION

This invention relates to an apparatus for allowing an individual to more safely perform exercises using weights.

When an individual uses weights, and especially free weights, the safest practice is to always employ a "spotter" to help him place the weights on the rack of a bench when he becomes fatigued. The "spotter" acts as a safety net with the intent of preventing the free weights from falling on the individual. Sometimes the spotter cannot handle the amount of weight being used. In addition, it is not always practical to employ a "spotter." Individuals often work out alone creating a risk of being seriously injured or trapped under the weights.

One solution to this problem is to use a system employing cable weights, bands, power rods, or inertial devices. These systems do not require an individual to lift weight directly over his body and thus allow an individual to more safely lift weights alone without the need for a "spotter".

However, the above systems have not been accepted by everyone as their preferred method of weight training. Some individuals prefer to use free weights, which provide a user with specific benefits such as requiring the use of stabilizer muscles to help balance the weight and maintain proper form. Various prior art "self-spotting" devices exist which attempt to provide the safety of cable systems while still providing the benefit of free weights. However, these prior art devices have shortcomings in that they do not always protect the user's body completely, they may unnecessarily limit the range of exercise motion, or may make it difficult for the user to escape from the equipment after a weight has been dropped. Furthermore, the devices are not easily adjustable for different body types or bench types.

Accordingly, there is a need for a weightlifting apparatus that allows an individual to perform free weight training exercises more safely through a full range of motion, with or without a "spotter."

SUMMARY OF THE INVENTION

Therefore, it is an object of the invention to provide a weightlifting apparatus that allows an individual to perform weightlifting exercises more safely with or without a spotter.

It is another object of the invention to provide a weightlifting apparatus that increases the safety of using free weights without a spotter.

It is another object of the invention to provide a weightlifting apparatus that allows a user to perform various exercises more safely using free weights or inertial machines.

It is another object of the invention to provide a weightlifting apparatus that provides self-spotter bars that do not interfere with the desired exercise.

It is another object of the invention to provide a weightlifting apparatus that has adjustable self-spotter bars.

It is another object of the invention to provide a weightlifting apparatus that provides self-spotter bars for more than one type of exercise.

These and other objects of the present invention are achieved in some of the preferred embodiments disclosed below by providing a weightlifting apparatus, including: at least two spaced-apart upwardly extending support columns and at least two spaced-apart self-spotter bars each having a first end and a second end. Each of the self-spotter bars is attached to one of the support columns, wherein the first end of each self-spotter bar is disposed at a first height relative to a horizontal reference plane and the second end of each self-spotter bar is disposed at a second height relative to the horizontal reference plane, the first height being greater than the second height. The self-spotter bars collectively define a work space for accommodating an individual performing an exercise with a weight bar positioned adjacent the second end of the self-spotter bars, wherein each of the self-spotter bars has a length sufficient to extend underneath the position of the weight bar during the exercise.

According to another preferred embodiment of the invention, the second end of each self-spotter bar is attached to one of the support columns and the first end of each self-spotter bar extends outwardly from the column to which it is attached.

According to another preferred embodiment of the invention, the support columns include at least two spaced-apart front vertical support columns and at least two spaced-apart intermediate columns. The first end of each self-spotter bar is attached to a one of the front columns and the second end is attached one of the intermediate columns.

According to another preferred embodiment of the invention, the overall length of each of the self-spotter bars may be adjustable.

According to another preferred embodiment of the invention, each of the self-spotter bars has a collar slidably engaged with a respective one of the support columns. The collar has a cross-sectional dimension greater than a cross-sectional dimension of the associated support column.

According to another preferred embodiment of the invention, the support columns include means for attaching the support columns to a support structure while allowing the self-spotter bars to slide along the support columns.

According to another preferred embodiment of the invention, each of the self-spotter bars is attached to one of the support columns at a center of the self-spotter bar.

According to another preferred embodiment of the invention, each of the support columns has at least one hole formed therethrough; each of the collars has at least one hole formed therethrough; and the self-spotter bars are retained in a selected vertical position by pins passing through the holes of the collars and the support columns.

According to another preferred embodiment of the invention, each of the at least two spaced-apart support columns is attached to a horizontal base support, and the base supports are connected by a cross member extending therebetween.

According to another preferred embodiment of the invention, the vertical position of the self-spotter bar is adjustable relative to the support columns.

According to another preferred embodiment of the invention, the weightlifting apparatus further includes a pair of spaced-apart rear columns; a pair of spaced-apart horizontal beams, wherein the spaced-apart rear columns are attached to the intermediate columns by the horizontal beams; and an adjustable weight bar support. The adjustable weight bar support is slidably positioned within the intermediate column for being adjusted in the vertical direction.

According to another preferred embodiment of the invention, the adjustable weight bar support comprises at least one hole for accepting a pin therethrough.

According to another preferred embodiment of the invention, each of the front and intermediate columns includes an array of holes formed therethrough; each of the self-spotter bars includes a first collar slidably engaged with one of the front columns and having a hole formed therethrough, and a second collar slidably engaged with one of the intermediate columns and having a hole formed therethrough. The self-spotter bars are retained in a selected vertical position by pins passing through the holes in the collars and the front and intermediate columns.

According to another preferred embodiment of the invention, each of the intermediate columns carries a weight support pin extending therefrom.

According to another preferred embodiment of the invention, A weightlifting apparatus includes: an optional weightlifting bench including a pair of first spaced-apart weight bar supports; at least two spaced-apart upwardly extending support columns; at least two spaced-apart self-spotter bars each having a first end and a second end, the self-spotter bars being attached to respective ones of the support columns, wherein the first end of each self-spotter bar is disposed at a first height relative to a horizontal reference plane and the second end of each self-spotter bar is disposed at a second height relative to the horizontal reference plane, the first height being greater than the second height.

The self-spotter bars collectively define a work space for accommodating an individual performing an exercise with a weight bar positioned adjacent the second end of the self-spotter bars, wherein each of the self-spotter bars has a length sufficient to extend underneath the position of the weight bar during, the weightlifting bench being positioned between the spaced-apart self-spotter bars.

According to another preferred embodiment of the invention, the second end of each self-spotter bar is attached to one of the support columns and the first end of each self-spotter bar outwardly extends from the support column.

According to another preferred embodiment of the invention, the support columns comprise at least two spaced-apart front columns and at least two spaced-apart intermediate columns, wherein the first end of each self-spotter bar is attached to one of the front columns and the second end is attached one of the intermediate columns.

According to another preferred embodiment of the invention, each of the self-spotter bars has a collar slidably engaged with one of the support columns, the collar having a cross-sectional dimension greater than a cross sectional dimension of the support column.

According to another preferred embodiment of the invention, the support columns include a means for attaching the support columns to a wall, while allowing the self-spotter bars to slide along the support columns.

According to another preferred embodiment of the invention, each of the self-spotter bars is attached to one of the support columns at a center of the self-spotter bar.

According to another preferred embodiment of the invention, each of the support columns has at least one hole formed therethrough; each of the collars has at least one hole formed therethrough; and the self-spotter bars are retained in a selected vertical position by pins passing through the holes of the collars and the support columns.

According to another preferred embodiment of the invention, each of the at least two spaced-apart generally vertically extending support columns is attached to a horizontal base support, and the horizontal base supports are connected by a cross member extending therebetween.

According to another preferred embodiment of the invention, the vertical position of the self-spotter bars are adjustable relative to the apparatus.

According to another preferred embodiment of the invention, the apparatus further includes a pair of spaced-apart rear columns and a pair of spaced-apart horizontal beams. The spaced-apart rear columns are attached to the intermediate columns by the horizontal beams.

According to another preferred embodiment of the invention, the apparatus further includes at least one adjustable second weight bar support, wherein the second weight bar support is slidably positioned within the intermediate column for being adjusted in the vertical direction.

According to another preferred embodiment of the invention, the adjustable weight bar support comprises at least one hole for accepting a pin therethrough.

According to another preferred embodiment of the invention, each of the front and intermediate columns includes an array of holes formed therethrough; each of the self-spotter bars includes a first collar slidably engaged with one of the front columns and having a hole formed therethrough, and a second collar slidably engaged with one of the intermediate columns and having a hole formed therethrough; and the self-spotter bars are retained in a selected vertical position by pins passing through the holes in the collars and the front and intermediate columns.

According to another preferred embodiment of the invention, the apparatus further includes a pair of spaced-apart upper columns attached to the rear columns for supporting an upper frame, wherein the upper frame includes: a pair of spaced-apart upper horizontal beams positioned generally perpendicular to a pair of spaced-apart upper columns, each of the upper horizontal beams having a first end connected to a top of one of the upper columns; and an elongated bar disposed across the upper horizontal beams at a free end thereof, the elongated bar being adapted to allow an individual to perform a chin-up exercise thereon.

According to another preferred embodiment of the invention, the apparatus further includes a pulley connected to the elongated bar; a cable having a first end and a second end, the cable passing over the pulley, the first end including means for attaching a weight thereto; and a handle attached to the second end of the cable.

According to another preferred embodiment of the invention, a weightlifting apparatus includes a pair of spaced-apart front columns; a pair of spaced-apart intermediate columns; and a pair of spaced-apart self-spotter bars each extending between one of the front columns and one of the intermediate columns. Each of the self-spotter bars has a first end positioned at a first height relative to the front column, and a second end positioned at a second height relative to the intermediate column, wherein the first and second heights are independently adjustable.

According to another preferred embodiment of the invention, each of the front and intermediate columns includes a pair of spaced-apart, vertically extending mounting plates, each having an array of holes formed therethrough; each of the first and second ends of the self-spotter bars includes an opening therethrough, and the first and second ends of the self-spotter bars are attached to the front and intermediate columns by pins extending through the holes and the openings.

According to another preferred embodiment of the invention, the first and second ends of the self-spotter bars each includes a U-shaped groove for engaging a pin.

According to another preferred embodiment of the invention, the first and second ends of the self-spotter bars each includes an elongated slot for engaging a pin.

According to another preferred embodiment of the invention, a total length of each of the self-spotter bars is adjustable.

According to another preferred embodiment of the invention, each of the self-spotter bars includes a collar pivotally attached to one of the first and second ends thereof, the collar being slidably engaged with one of the front and intermediate columns and retained thereto by a pin passing through the collar and the one of the columns.

According to another preferred embodiment of the invention, the apparatus further includes a pair of adjustable weight bar supports, wherein each of the adjustable weight bar supports is slidably positioned within one of the intermediate columns for being adjusted in the vertical direction.

According to another preferred embodiment of the invention, each of the adjustable weight bar supports comprises at least one hole for accepting a pin therethrough.

According to another preferred embodiment of the invention, the apparatus further includes a pair of spaced-apart rear columns and a pair of spaced-apart horizontal beams, wherein the spaced-apart rear columns are attached to the intermediate columns by the horizontal beam.

According to another preferred embodiment of the invention, the apparatus further includes a pair of spaced-apart upper columns attached to the rear columns for supporting an upper frame. The upper frame comprises a pair of spaced-apart upper horizontal beams positioned perpendicular to the upper columns, each of the upper horizontal beams having a first end connected to a top of one of the upper columns; and an elongated bar disposed perpendicular to and carried by the horizontal beams at a free end thereof, the elongated bar being adapted to allow an individual to perform a chin-up exercise thereon.

According to another preferred embodiment of the invention, the apparatus further includes a pulley connected to the elongated bar; a cable having a first end and a second end, the cable passing over the pulley, the first end including means for attaching a weight thereto; and a handle attached to the second end of the cable.

BRIEF DESCRIPTION OF THE DRAWINGS

The invention may be best understood by reference to the following description taken in conjunction with the following drawings, in which.

DESCRIPTION OF THE PREFERRED EMBODIMENT AND BEST MODE

Figure 1:
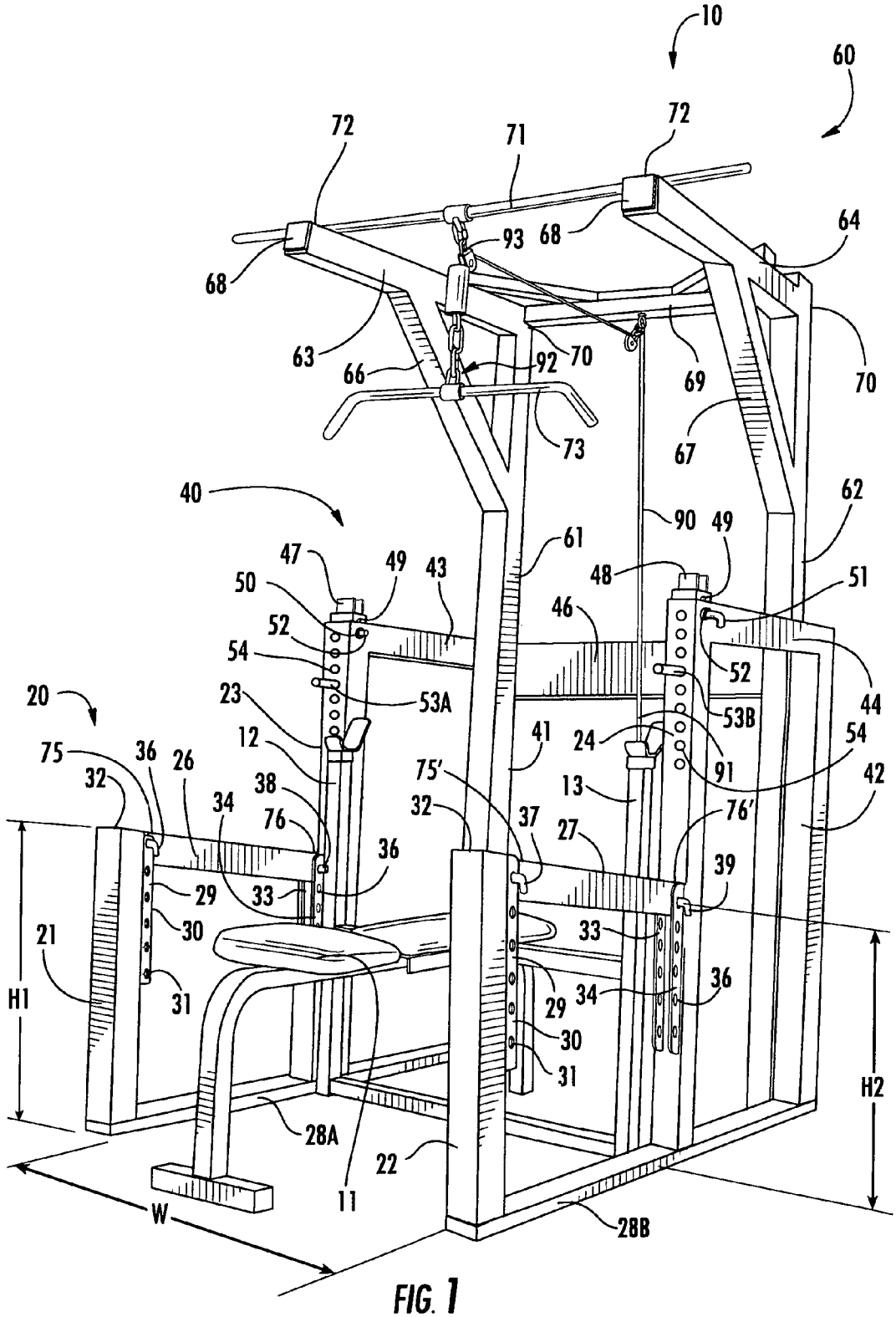
FIG. 1 shows a perspective view of a weightlifting apparatus constructed in accordance with the present invention.
Figure 2:
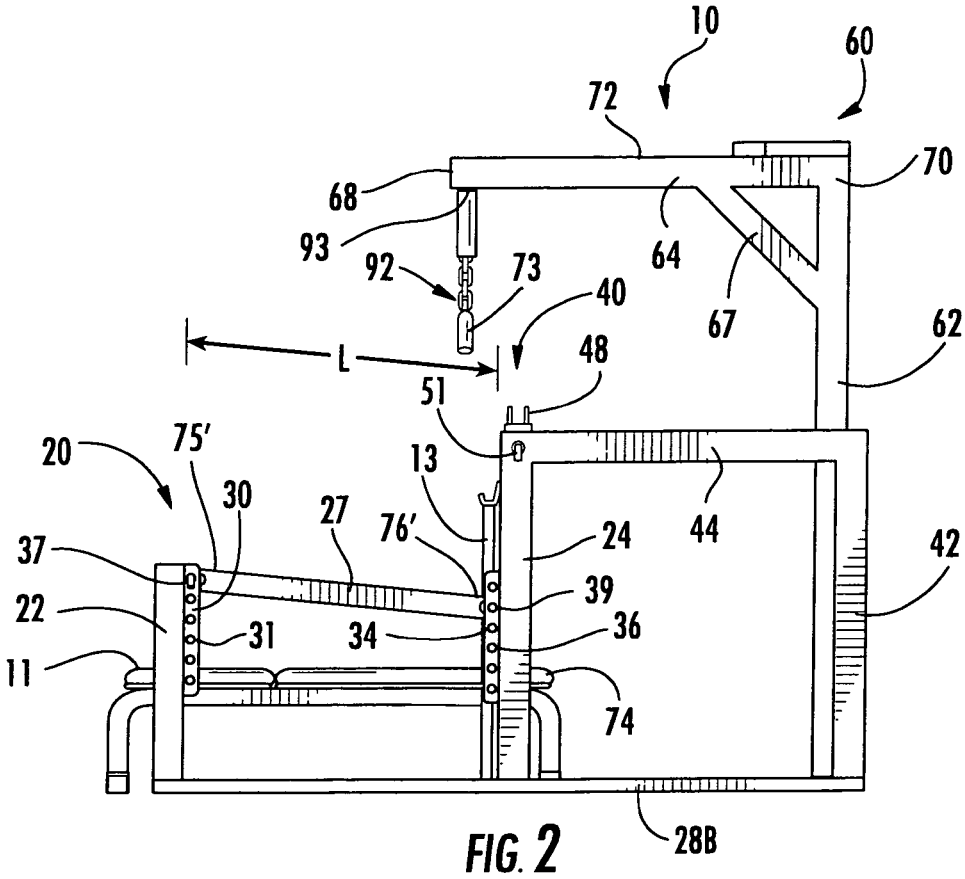
FIG. 2 shows a side elevation of the weightlifting apparatus of FIG. 1.
Figure 3:
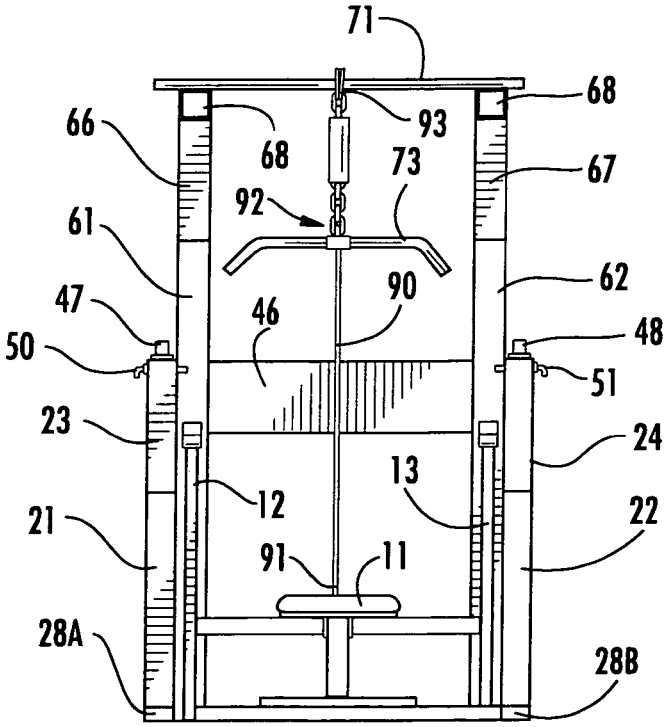
FIG. 3 shows a front elevation of the weightlifting apparatus of FIG. 1.

Referring now specifically to the drawings, a weightlifting apparatus of the present invention is illustrated in FIGS. 1-3 and shown generally at reference numeral 10. The weightlifting apparatus 10 of the present invention is designed to work with or without a weightlifting bench 11. The weightlifting apparatus 10 generally includes three sections for performing a variety of exercises. In the illustrated example, each section is fabricated of square cross-section tubular steel elements which are welded together. However, any suitable material or structural shape having sufficient strength to support weight bars (such as barbells) may be used.

The first section shown generally at 20 is designed for use with a weightlifting bench 11 to provide an individual with the ability to perform an exercise more safely with or without a "spotter." The first section 20 includes two spaced-apart front columns 21 and 22, two spaced-apart intermediate columns 23 and 24, and a pair of spaced-apart self-spotter bars 26 and 27. Although "columns" are generally upright structural members, they need not be disposed exactly vertical or perpendicular to a supporting surface. They may be disposed at varying angles, and may be made pivotal if desired. The front columns 21 and 22 are attached to the intermediate columns 23 and 24 and two spaced-apart rear columns 41 and 42 via a pair of spaced-apart bottom plates 28A and 28B. The pairs of front and intermediate columns 21, 22, 23, and 24 are separated by a width, denoted "W", which is sufficient to accommodate the weightlifting bench 11 but is less than the width of a weight bar (not shown). Although the width W is fixed in the illustrated example, the weightlifting apparatus 10 may also be constructed so that the width W can be adjusted. The front columns, intermediate columns, and self-spotter bars collectively define a work space for accommodating an individual performing a bench press or other exercise. The front columns 21 and 22 preferably have a height less than the intermediate columns 23 and 24. Each of the front columns 21 and 22 includes a pair of vertically-extending spaced-apart mounting plates 29 and 30 each having a plurality of holes 31. The mounting plates 29 and 30 are positioned at the top end 32 of each column 21 and 22. Identical pairs of vertically-extending mounting plates 33 and 34 each having a plurality of holes 36 are fixed to the intermediate columns 23 and 24 and positioned opposite vertical plates 29 and 30.

A pair of self-spotter bars 26 and 27 having respective first ends 75, 75' and second ends 76, 76' extend between the front columns 21 and 22 and the intermediate columns 23 and 24. The self-spotter bars 26 and 27 may be attached to the front columns 21 and 22 and intermediate columns 23 and 24 so that the heights "H1" and "H2" of the first and second ends 75, 75' and 76, 76' may be adjusted independently. In the illustrated example, the self-spotter bars 26 and 27 are attached to the front and intermediate columns 21, 22, 23, and 24 via the vertical mounting plates 29, 30, 33, and 34 and hitch pins 36, 37, 38, and 39. This configuration allows the adjustment of the vertical height and angular position of the self-spotter bars 26 and 27. Thus, the self-spotter bars 26 and 27 can be adjusted to a position that prevents a weight bar from lying on an individual's neck or chest, but allows a full range of motion when performing the bench press or similar exercise.

A pair of weight support pins 53A and 53B are attached to the intermediate columns 23 and 24. In the illustrated example the intermediate columns 23 and 24 each have an array of spaced-apart holes 54 formed therein for receiving the weight support pins 53A and 53B at the a height preferred by the user. When the weight support pins 53A and 53B are installed they provide a place to rest a weight bar (not shown) above the self-spotter bars 26 and 27. This is helpful in supporting the weight bar at a desired starting position independent of the weight bar supports 12 and 13 of the bench 11.

Figure 4:
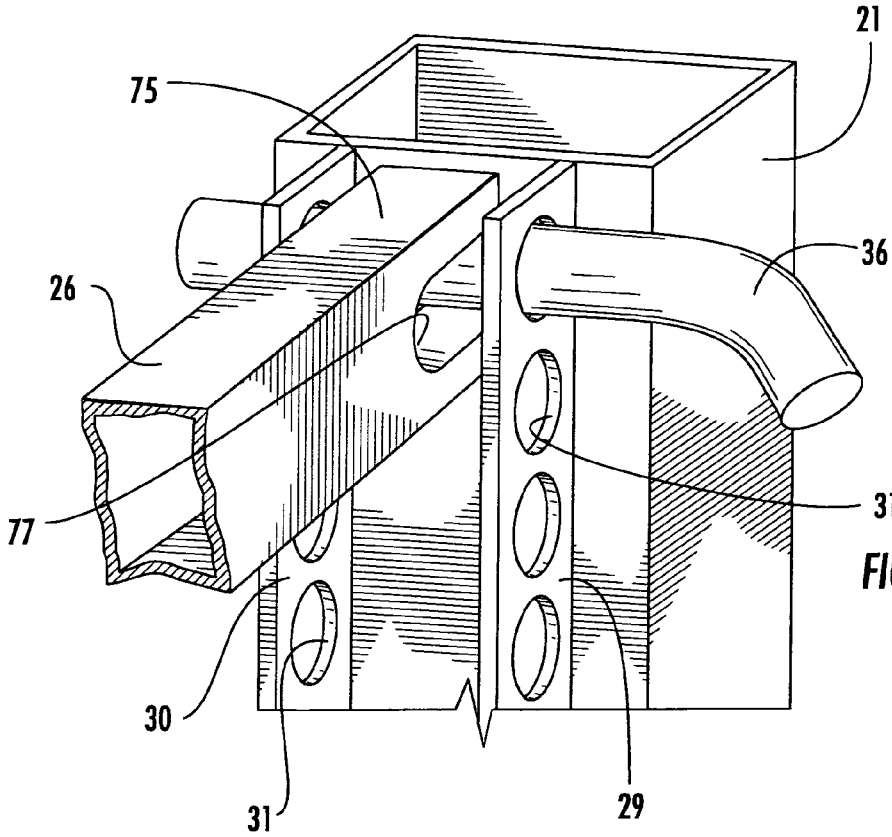
FIG. 4 shows a partial perspective view of the end of a self-spotter bar.
Figure 5:
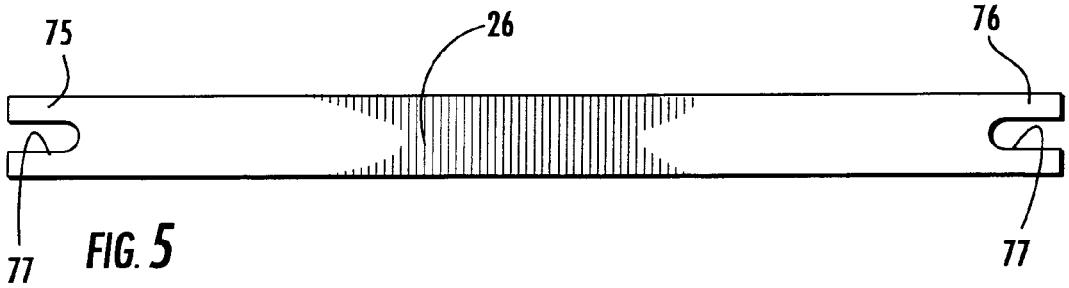
FIG. 5 shows a side view of a self-spotter bar.
Figure 11:
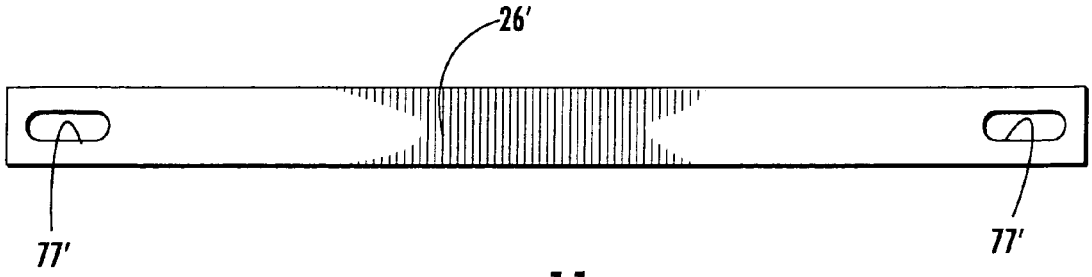
FIG. 11 shows a side view of an alternative self-spotter bar.

The attachment of the self-spotter bars 26 and 27 is shown in greater detail in FIGS. 4 and 5. The self-spotter bar 26 has a first end 75 and second end 76, each with a U-shaped groove 77 for accepting a hitch pin. As shown on the alternative self-spotter bar 26' in FIG. 11, a closed-ended elongated slot 77' may be substituted for one or more of the U-shaped grooves. For illustrative purposes, FIG. 4 only shows one self-spotter connection, however, all four connections may be the same. The first end 75 of the self-spotter bar 26 is positioned between mounting plates 29 and 30 of front column 21. The self-spotter bar 26 is held in place by a hitch pin 36 which extends through holes 31 in each of the mounting plates 29 and 30 and the U-shaped groove 77 of the self-spotter bar 26.

Figure 6:
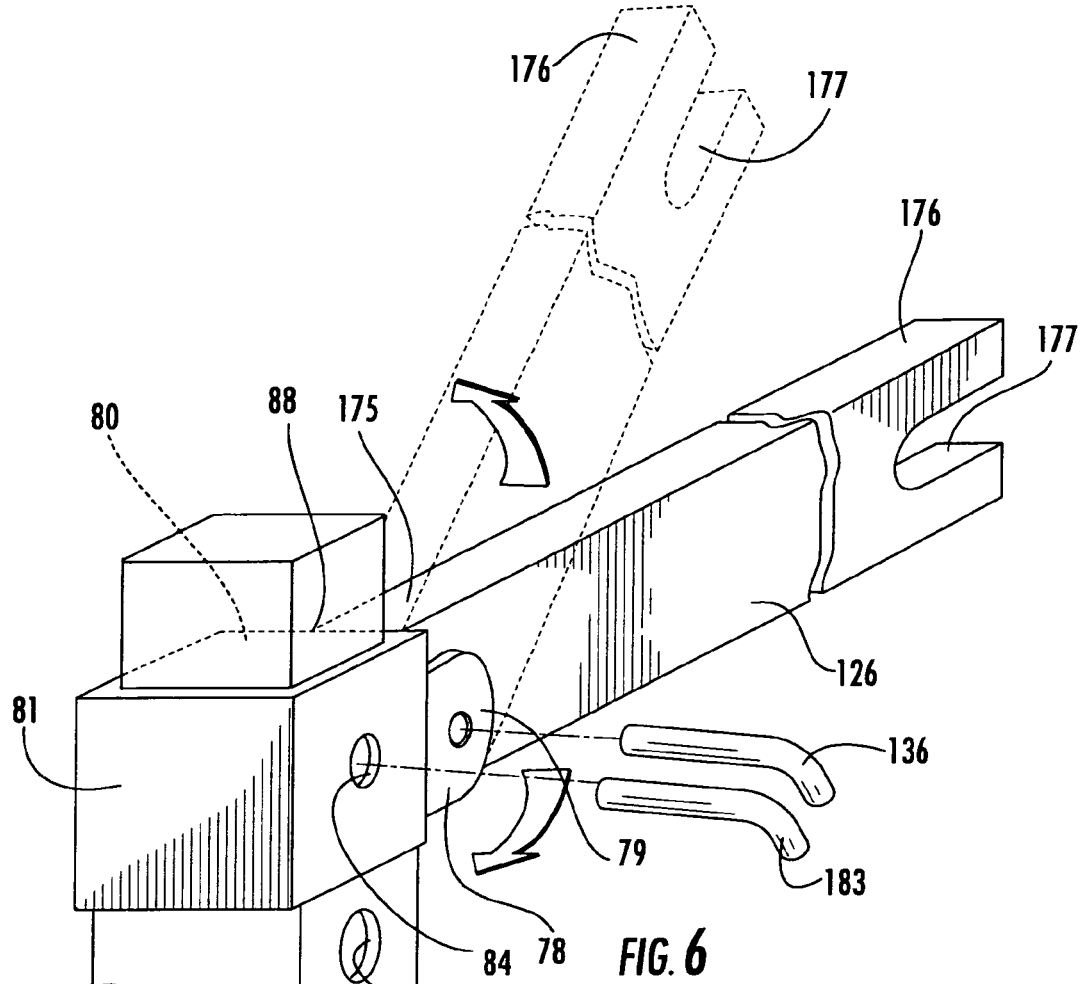
FIG. 6 shows a partial perspective view of an alternative self-spotter bar.

FIG. 6 shows an alternative structure for connecting the self-spotter bars to the front columns including a front column 121 and a self-spotter bar 126, which are similar to front column 21 and self-spotter bar 26 described above. In this embodiment, the first end 175 of the self-spotter bar 126 is attached to a collar 81 via a single hinge 78 having a pair of flanges 79 and 80 residing on opposite sides of the self-spotter bar 126. Also, the front column 121 includes a plurality of holes 82 for allowing the height H1 of the first end 175 to be adjusted. For illustrative purposes, FIG. 6 only shows one self-spotter bar connection. The self-spotter bar 126 is positioned between the pair of flanges 79 and 80 of hinge 78 and held in position by a hitch pin 136. The collar 81 has a cross-sectional dimension greater than the cross-sectional dimension of a front column 121 and is slid over the front column 121 and attached to the front column 121 by a hitch pin 83 protruding through hole 84 of the collar 81 and a corresponding hole 82 in the front column 121. The second end 176 of the self-spotter bar 126 includes a U-shaped groove 177 for mounting the second end 176 as described above. The above configuration could also be reversed to allow the collar 81 to be slid over the intermediate column instead of the front column.

Figure 8:
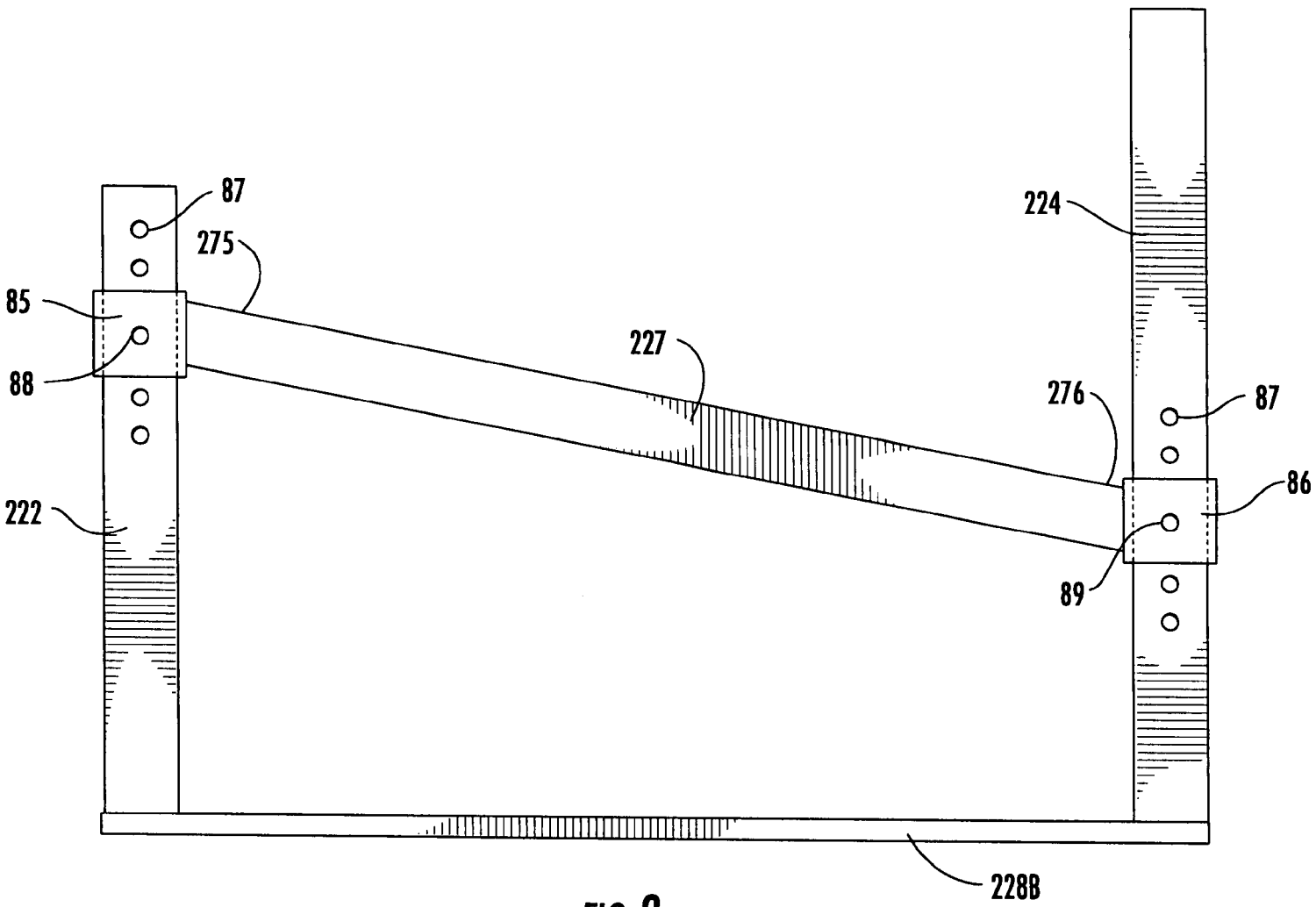
FIG. 8 shows a side elevation of an alternative self-spotter bar attached to the weightlifting apparatus.

FIG. 8 shows an alternative structure for connecting the self-spotter bars to the front columns including a front column 222, an intermediate column 224, and a self-spotter bar 227, which are similar to front column 22, intermediate column 24, and self-spotter bar 27 described above, respectively. In this embodiment, the first end 275 of the self-spotter bar 227 is attached to a first collar 85 and the second end 276 of the self-spotter bar 227 is attached to a second collar 86. The collars 85 and 86 have a cross-sectional dimension greater than the cross-sectional dimension of the front column 222 and the intermediate column 224 allowing the collars to slide along the columns 222 and 224. For illustrative purposes, FIG. 8 only shows one self-spotter bar attached to front and intermediate columns 222 and 224. The self-spotter bar 227 is attached to the first and second collars 85 and 86 so that the self-spotter bar 227 maintains a constant angle with a horizontal plane. The front and intermediate columns 222 and 224 include a plurality of holes 87 to allow a height adjustment of the self-spotter bar 227. The first and second collars 85 and 86 are attached to the front and intermediate columns 222 and 224 via hitch pins (not shown). The hitch pins extend through holes 88 and 89 of the first collar 85 and the second collar 86 and into the corresponding holes 87 of the front column 222 and the intermediate column 224.

Figure 12:
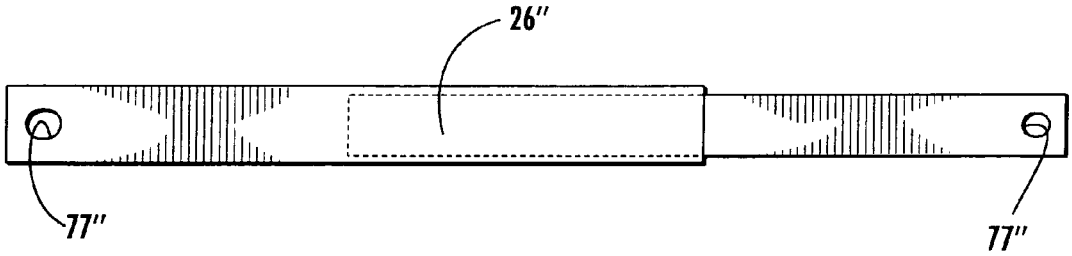
FIG. 12 shows a side view of another alternative self-spotter bar.

FIG. 12 shows an example of another alternative self-spotter bar 26". The self-spotter bar 26" is constructed from two sections which are connected in telescoping fashion so that the overall length of the self-spotter bar 26" can be adjusted. When disposed between front and intermediate columns 21 and 23 as described above, this telescoping action allows the height of each end of the self-spotter bar 26" to be adjusted individually while using simple holes 77" at each end for mounting, instead of using the U-shaped grooves 77 or elongated slots 77'.

In use, the weightlifting bench 11 is positioned between the self-spotter bars 26 and 27 in a position where the weight bar supports 12 and 13 of the weightlifting bench 11 are far enough in front of the intermediate columns 23 and 24 to allow clearance of a weight bar during the bench press exercise. The self-spotter bars 26 and 27 extend from the front columns 21 and 22 to the intermediate columns 23 and 24 to provide a self-spotter bar that extends a length, denoted "L", which is sufficient to extend underneath the position of the weight bar during the bench press or similar exercise. For example, the length "L" may be from about 24 inches to about 48 inches. Unlike prior art self-spotter devices, the positive stop provided by the intermediate columns 23 and 24 prevents the weight bar from rolling off of the self-spotter bars 26 and 27 and onto the individual. In addition, the extension of the self-spotter bars from the front columns 21 and 22 to the intermediate columns 23 and 24 allows the user to drop the weight bar onto the self-spotter bars 26 and 27 at any position above his body.

While the self-spotter bars 26 and 27 could be adjusted to provide various heights and various angles, it is preferred that height H1 be greater than height H2. In this configuration, the individual can lower the second end 76 of the self-spotter bars 26 and 27 to the desired height H2 to allow a full range of motion when performing the bench press or similar exercise and raise the first end 75 of the self-spotter bars 26 and 27 to the desired height H1 to allow the individual to escape from underneath the weight bar. Thus, the individual can drop the weight bar onto the self-spotter bars 26 and 27 and then roll the weight bar "up-hill" towards the individual's feet allowing the individual to easily escape. The individual could also slide out from underneath the weight bar to the side.

The second section shown generally at 40 is designed to allow an individual to perform a squat exercise without a "spotter." The second section 40 works in combination with the first section 20 to provide an individual performing the squat exercise with a self-spotter. The second section 40 includes the intermediate columns 23 and 24 described above, two spaced-apart rear columns 41 and 42, two spaced-apart horizontal beams 43 and 44 extending between the intermediate columns 23 and 24 and the rear columns 41 and 42, a cross-beam 46 extending between the two rear columns 41 and 42, and adjustable weight bar supports 47 and 48 disposed at the top of each intermediate column 23 and 24.

Figure 7:
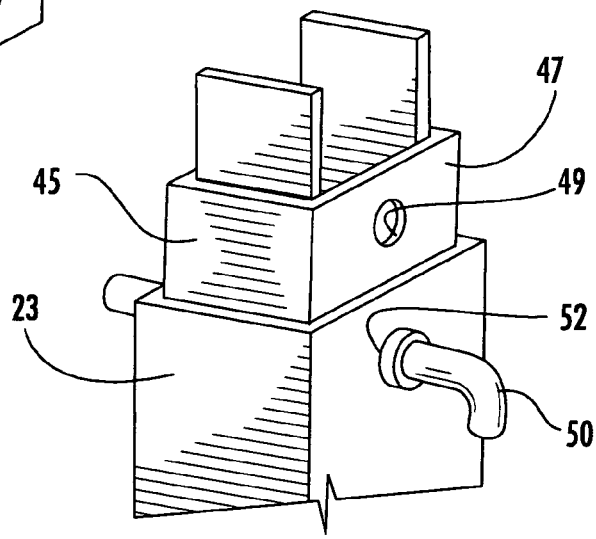
FIG. 7 shows an adjustable weight bar support column.

The adjustable weight bar supports are shown in detail in FIG. 7. Each weight bar support comprises an inner tube 45 having a cross-sectional dimension smaller than the cross-sectional dimension of the intermediate columns 23 and 24. The weight bar supports 47 and 48 slide within the intermediate columns 23 and 24 and include an array of holes 49, only one of which is shown in FIG. 7, for accepting hitch pins 50 and 51. By adjusting the height of the weight bar supports 47 and 48, the supports 47 and 48 can be adjusted to the proper height for each individual using the weightlifting apparatus 10. Once the weight bar supports 47 and 48 are positioned at a desired height, the hitch pins 50 and 51 are inserted through a hole 52 in the intermediate columns 23 and 24 to the corresponding hole 49 in the weight bar supports 47 and 48.

When a squat exercise is performed, the individual lifts the weight bar off of the weight bar supports 47 and 48 positioned on the intermediate columns 23 and 24 and steps forward or backward into an area between the self-spotter bars 26 and 27 of the first section 20. The self-spotter bars 26 and 27 are adjusted to a height low enough to prevent interference with the squat exercise and high enough to provide a weight bar support in the event the individual loses control of the weight. If the individual loses control of the weight bar from a loss of balance or fatigue, the self-spotter bars 26 and 27 catch the weight bar and prevent the weight bar from falling and thereby causing injury. The angle of the self-spotter bars 26 and 27 causes the weight bar to roll towards the intermediate columns 23 and 24 away from the individual where the intermediate columns 23 and 24 provide a positive stop for the weight bar preventing it from falling off of the self-spotter bars 26 and 27 and onto the floor.

The third section of the weightlifting apparatus shown generally at 60 is designed to allow an individual to perform various exercises, including lat pull-downs and chin-ups. The third section 60 is attached to the second section 40 of the weightlifting apparatus 10 at the rear columns 41 and 42. The third section 60 includes two spaced-apart upper columns 61 and 62, two spaced-apart horizontal upper beams 63 and 64, and two spaced apart angled beams 66 and 67 extending at approximately 45 degrees from the upper columns 61 and 62 to a free end 68 of the upper beams 63 and 64. The upper columns 61 and 62 may be made height-adjustable if desired. For example, they may be inserted into hollow rear columns 41 and 42, respectively, and secured with pins through holes formed therein, or other suitable means. The upper columns 61 and 62 could also be made integral with respective ones of the rear columns 41 and 42 if desired. A horizontal upper cross-beam 69 is positioned between the two upper beams 63 and 64 and integrally attached to a rear end 70 of the horizontal beams 63 and 64.

A chin-up bar 71 is carried by the two horizontal beams 63 and 64. In the illustrated example it is fixed to a top surface 72 thereof. The chin-up bar 71 is positioned towards the free ends 68 of the upper beams 63 and 64. In addition to allowing performance of chin-ups, the chin-up bar 71 provides a support for a pulley 93. A cable 90 passes over the pulley 93 and has a first end 91 including known means for attaching a weight, and a second end 92 for attaching a high pulley exercise device, for example a lat pull-down bar 73, as illustrated, or other type of handle The upper beams 63 and 64 extend outwardly toward the intermediate columns 23 and 24 to a position beyond the intermediate columns 23 and 24 to position the lat pull-down bar 73 in a location vertically above an end 74 of the weightlifting bench 11. This allows an individual to sit on the end of the weightlifting bench 11 and perform exercises using the lat pull-down bar 73 or handle, or other exercises such as leg extension exercises. When performing chin-ups, the bench 11 may be removed from the weightlifting apparatus 10 to provide an unrestricted chin-up area.

Figure 9:
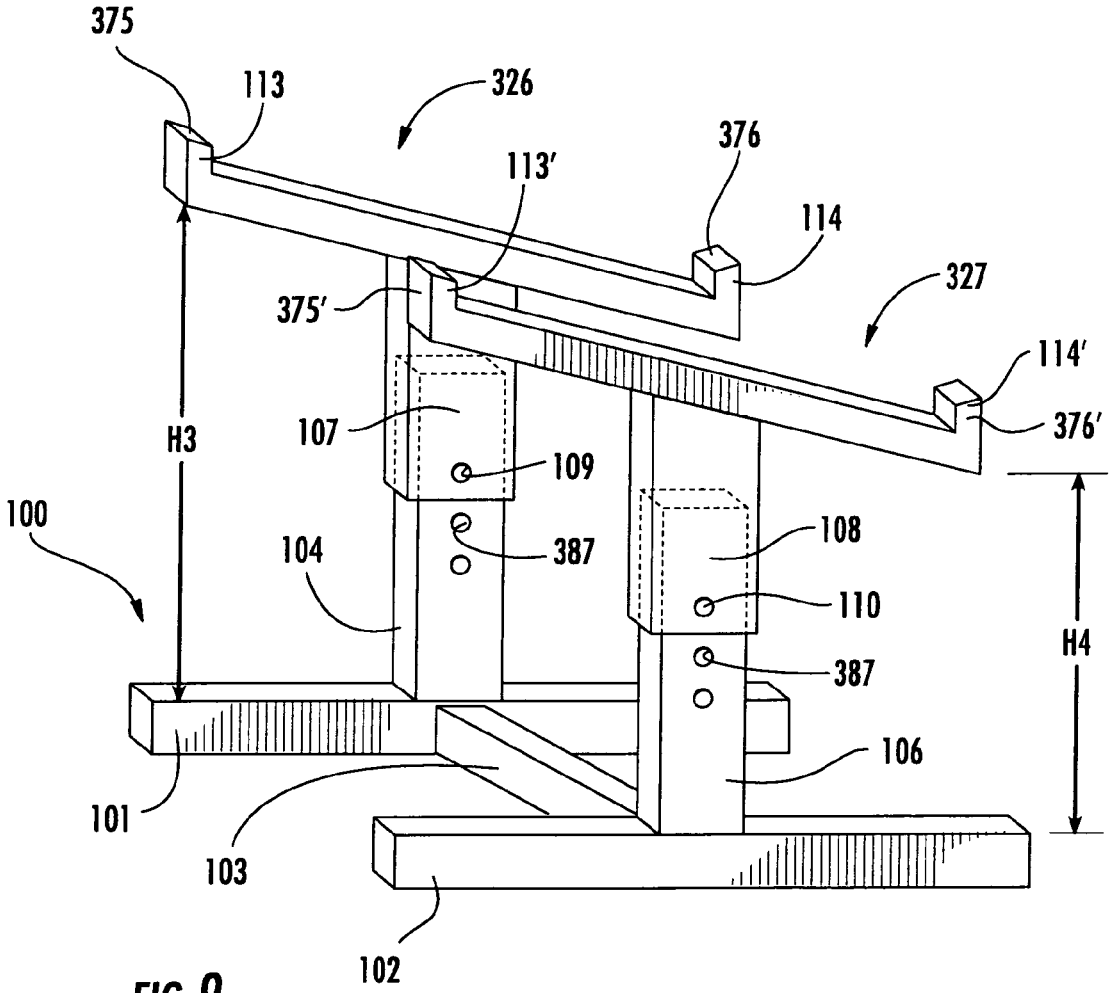
FIG. 9 shows a perspective view of an alternative self-spotter apparatus for sliding under a weightlifting apparatus.

FIG. 9 shows an alternative self-spotter apparatus for use with a weightlifting bench (not shown). The self-spotter apparatus includes a pair of spaced-apart self-spotter bars 326 and 327, each having a first end 375, 375' respectively and a second end 376, 376' respectively. The self-spotter bars 326 and 327 also include upwardly extending positive stops 113, 113', 114, 114' disposed at the first and second ends 375, 375', 376, 376' thereof. Each self-spotter bar 375, 376 has a downwardly-extending collar 107, 108, respectively having holes 109, 110 formed therethrough. The self-spotter bars 375 and 376 are supported by an H-shaped base 100 which includes first and second spaced-apart horizontal base supports 101, 102 and a horizontal cross-member 103. The first and second horizontal base supports 101, 102 are connected by the horizontal cross-member 103 extending therebetween. First and second spaced-apart vertical support columns 104, 106 are attached to the horizontal base supports 101, 102. and are slidably received in the collars 107 and 108. The vertical support columns 104 and 106 include a plurality of holes 387. The collars 107 and 108 are attached to the vertical support columns 104 and 106 via hitch pins (not shown). The hitch pins extend through holes 109 and 110 of the collars 107 and 108 and into the corresponding holes 387 of the vertical support columns 104, 106 to allow a height adjustment of the self-spotter bars 326, 327. The self-spotter bars 326 and 327 are disposed at an angle. The first ends 375, 375' have a height H3, referenced from a horizontal reference plane, greater than a height H4 of the second ends 376, 376'.

Figure 10:
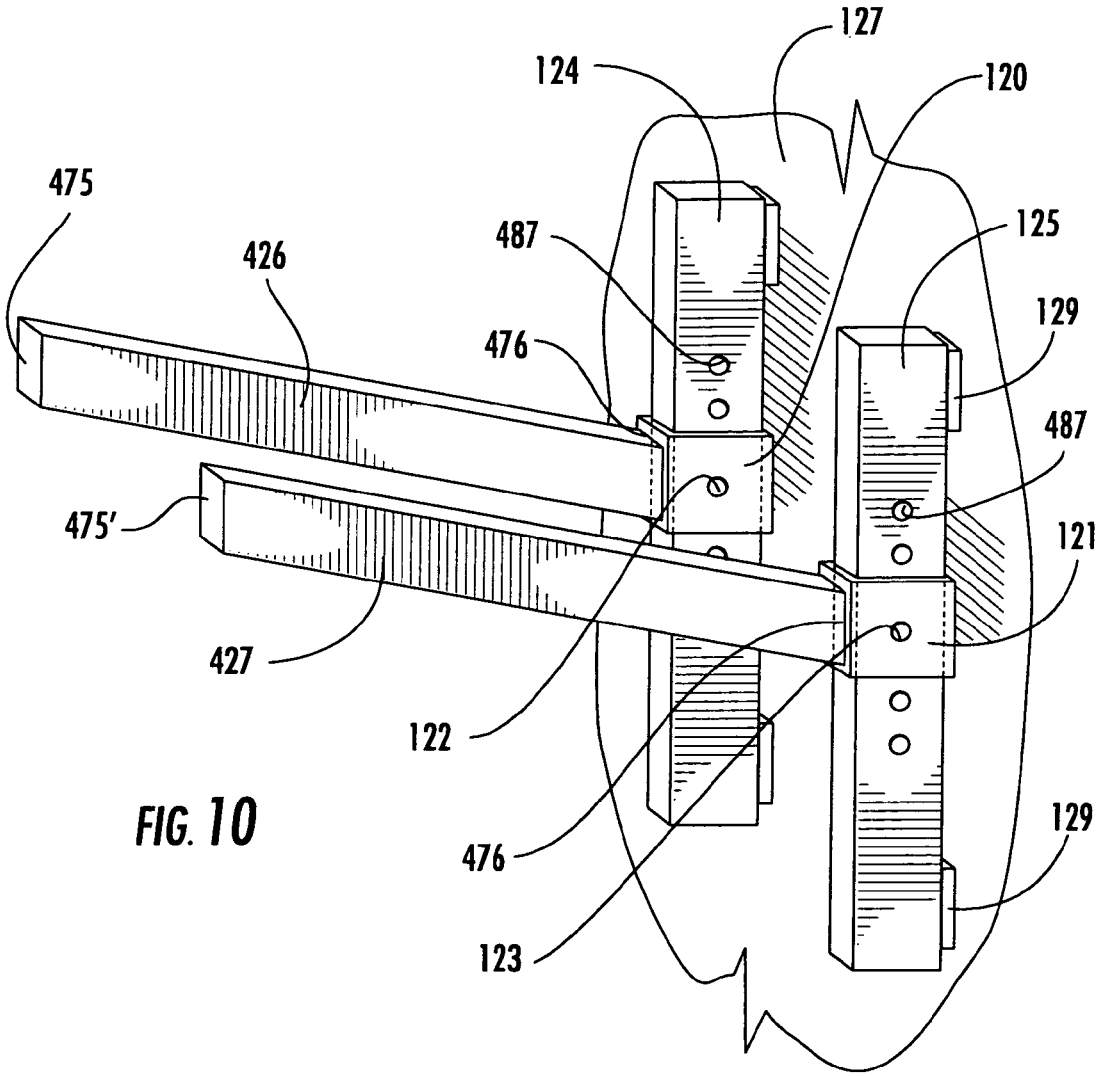
FIG. 10 shows a perspective view of an alternative self-spotter apparatus attached to support columns which are fixed to a wall.

FIG. 10 shows another alternative self-spotter apparatus. The apparatus includes a pair of spaced-apart self-spotter bars 426 and 427 each having respective first ends 475 and 475' and second ends 476 and 476'. The second ends are attached to respective vertical support columns 124 and 125, while the first ends 475, 475' are free. The vertical supports 124, 125 can be attached to a wall 127, to the weightlifting apparatus described above with respect to FIGS. 1-3, or to any other vertical structure suitable for supporting the self-spotter bars 426, 427 and the weight expected to be placed thereon. In the illustrated example, the second ends 476, 476' of each of the self-spotter bars 426, 427 are attached to collars 120 and 121. The collars 120 and 121 have a cross-sectional dimension greater than the cross-sectional dimension of the vertical support columns 124 and 125 allowing the collars 120, 121 to slide along the support columns 124, 125.

The self-spotter bars 426, 427 are attached to the collars 120 and 121 so that the self-spotter bars 426 and 427 maintain a constant angle with respect to a horizontal reference plane, for example a floor. The vertical support columns 124 and 125 include a plurality of holes 487 to allow a height adjustment of the self-spotter bars 426 and 427. The collars 120, 121 are attached to the vertical support columns via hitch pins (not shown) which extend through holes 122 and 123 of the collars 120 and 121 and into the corresponding holes 487 of the vertical support columns 124 and 125. Brackets 129 or similar structures may be provided so that the self-spotter bars 426 and 427 can be attached to the wall 127 without interfering with their vertical adjustment.

A weightlifting apparatus for allowing an individual to more safely perform weightlifting exercises using free weights without a "spotter" is described above. The inventor is not acting as his own lexicographer, and the terms used herein are intended to have their ordinary meaning. Various details of the invention may be changed without departing from its scope. The invention is not restricted to the slavish imitation of each and every detail set forth above. Obviously, devices may be provided which change, add, or eliminate certain specific details without departing from the scope of the invention. Furthermore, the foregoing description of the preferred embodiments of the invention and the best mode for practicing the invention are provided for the purpose of illustration only and not for the purpose of limitation, the invention being identified in the claims.

What is claimed is:

1. A weightlifting apparatus, comprising:

(a) at least two spaced-apart upwardly extending front support columns, at least two spaced-apart upwardly extending intermediate support columns, and at least two upwardly extending spaced apart rear support columns;

(b) at least two spaced-apart self-spotter bars each having a first end and a second end, each of said self-spotter bars being adjustably attached to one of said front columns at their first end and to one of said intermediate columns at their second end, wherein said first end of each self-spotter bar is disposed at a first height relative to a horizontal reference plane and said second end of each self-spotter bar is disposed at a second height relative to said horizontal reference plane, said first height being greater than said second height;

(c) wherein said self-spotter bars collectively define a work space for accommodating an individual performing an exercise with a weight bar positioned adjacent said second end of said self-spotter bars, wherein each of said self-spotter bars has a length sufficient to extend underneath the position of the weight bar during said exercise;

(d) a pair of spaced-apart horizontal beams, wherein said spaced-apart rear columns are attached to said intermediate columns by said horizontal beams; and (e) an adjustable weight bar support, wherein said adjustable weight bar support is slidably positioned within said intermediate column for being adjusted in the vertical direction.

2. The weightlifting apparatus according to claim 1 wherein the overall length of each of said self-spotter bars is adjustable.

3. The weightlifting apparatus according to claim 1, wherein each of said self-spotter bars has a collar slidably engaged with a respective one of said front and intermediate support columns, said collar having a cross-sectional dimension greater than a cross-sectional dimension of the associated support column.

4. The weightlifting apparatus according to claim 2, wherein:

(a) each of said front and intermediate support columns has at least one hole formed therethrough;

(b) each of said collars has at least one hole formed therethrough; and (c) wherein said self-spotter bars are retained in a selected vertical position by pins passing through said holes of said collars and said front and intermediate support columns.

5. The weightlifting apparatus according to claim 1, wherein each of said at least two spaced-apart front, intermediate and rear support columns is attached to horizontal base supports, and said base supports are connected by a cross member extending therebetween.

6. A weightlifting apparatus according to claim 1, wherein the vertical position of each of said self-spotter bars is adjustable relative to said front and intermediate support columns.

7. A weightlifting apparatus according to claim 1, wherein said adjustable weight bar support comprises at least one hole for accepting a pin therethrough.

8. A weightlifting apparatus according to claim 1, wherein:

(a) each of said front and intermediate columns includes an array of holes formed therethrough;

(b) each of said self-spotter bars includes a first collar slidably engaged with one of said front columns and having a hole formed therethrough, and a second collar slidably engaged with one of said intermediate columns and having a hole formed therethrough; and (c) said self-spotter bars are retained in a selected vertical position by pins passing through said holes in said collars and said front and intermediate columns.

9. A weightlifting apparatus according to claim 1, wherein each of said intermediate columns carries a weight support pin extending therefrom.

10. A weightlifting apparatus, comprising:

(a) a pair of spaced-apart front columns;

(b) a pair of spaced-apart intermediate columns;

(c) a pair of spaced-apart self-spotter bars each extending between one of said front columns and one of said intermediate columns, wherein each of said self-spotter bars has a first end positioned at a first height relative to said front column, and a second end positioned at a second height relative to said intermediate column, wherein said first and second heights are independently adjustable;

(d) a pair of spaced-apart rear columns and a pair of spaced-apart horizontal beams, wherein said spaced-apart rear columns are attached to said intermediate columns by said horizontal beams;

(e) wherein each of said front and intermediate columns includes a pair of spaced-apart, vertically extending mounting plates, each having an array of holes formed therethrough;

(f) wherein each of said first and second ends of said self-spotter bars includes an opening therethrough, and (g) wherein said first and second ends of said self-spotter bars are attached to said front and intermediate columns by pins extending through said holes and said openings.

11. A weightlifting apparatus according to claim 10, wherein said first and second ends of said self-spotter bars each includes a U-shaped groove for engaging a pin.

12. A weightlifting apparatus according to claim 10 wherein said first and second ends of said self-spotter bars each includes an elongated slot for engaging a pin.

13. A weightlifting apparatus according to claim 10 wherein a total length of each of said self-spotter bars is adjustable.

14. A weightlifting apparatus according to claim 10, wherein each of said self-spotter bars includes a collar pivotally attached to one of said first and second ends thereof, said collar being slidably engaged with one of said front and intermediate columns and retained thereto by a pin passing through said collar and said one of said columns.

15. A weightlifting apparatus according to claim 10, further comprising a pair of adjustable weight bar supports, wherein each of said adjustable weight bar supports is slidably positioned within one of said intermediate columns for being adjusted in the vertical direction.

16. A weightlifting apparatus according to claim 10, wherein each of said adjustable weight bar supports comprises at least one hole for accepting a pin therethrough.

17. A weightlifting apparatus according to claim 10, further comprising a pair of spaced-apart upper columns attached to said rear columns for supporting an upper frame, wherein said upper frame comprises:

(a) a pair of spaced-apart upper horizontal beams positioned perpendicular to said upper columns, each of said upper horizontal beams having a first end connected to a top of one of said upper columns; and (b) an elongated bar disposed perpendicular to and carried by said horizontal beams at a free end thereof, said elongated bar being adapted to allow an individual to perform a chin-up exercise thereon.

18. A weightlifting apparatus according to claim 17, further comprising:

(a) a pulley connected to said elongated bar;

(b) a cable having a first end and a second end, said cable passing over said pulley, said first end including means for attaching a weight thereto; and (c) a handle attached to said second end of said cable.

* * * * *